US009506280B2

(12) United States Patent
Aykas

(10) Patent No.: US 9,506,280 B2
(45) Date of Patent: Nov. 29, 2016

(54) ADJUSTABLE CORNER FITTING

(71) Applicant: DORMA Deutschland GmbH, Ennepetal (DE)

(72) Inventor: Kenan Aykas, Ennepetal (DE)

(73) Assignee: DORMA DEUTSCHLAND GMBH, Ennepetal (DE)

( * ) Notice: Subject to any disclaimer, the term of this patent is extended or adjusted under 35 U.S.C. 154(b) by 0 days.

(21) Appl. No.: 14/958,561

(22) Filed: Dec. 3, 2015

(65) Prior Publication Data

US 2016/0160547 A1 Jun. 9, 2016

(30) Foreign Application Priority Data

Dec. 4, 2014 (EP) ..... 14196226

(51) Int. Cl.

| | |
|---|---|
| ***E05D 5/02*** | (2006.01) |
| ***E05D 7/081*** | (2006.01) |
| ***E05D 7/04*** | (2006.01) |
| *E05D 15/54* | (2006.01) |

(52) U.S. Cl.

CPC ..... *E05D 7/081* (2013.01); *E05D 5/0246* (2013.01); *E05D 7/04* (2013.01); *E05D 15/54* (2013.01); *E05D 2007/0484* (2013.01); *E05Y 2600/12* (2013.01); *E05Y 2600/502* (2013.01); *E05Y 2800/672* (2013.01); *E05Y 2900/132* (2013.01)

(58) Field of Classification Search

CPC ..... E05D 5/0246; E05D 5/02; E05D 2005/0261; E05D 2005/0269; E05D 2005/0253; E05D 7/081; E05D 7/08; E05D 7/082; E05D 7/083; E05D 7/084; E05D 7/04; E05D 7/043; E05Y 2900/114; E05Y 2600/502; E05Y 2600/60; E05Y 2800/672; E05F 11/385; E06B 3/54; A47K 3/362; A47K 2003/367; A47F 3/12; A47F 3/125; Y10T 16/534; Y10T 16/5326; Y10T 16/554; Y10T 16/5323

See application file for complete search history.

(56) References Cited

U.S. PATENT DOCUMENTS

| | | | | |
|---|---|---|---|---|
| 3,828,394 | A * | 8/1974 | Horgan, Jr. | E05D 5/0246 16/241 |
| 4,142,272 | A * | 3/1979 | Oogami | E05D 7/0423 16/245 |
| 4,200,956 | A * | 5/1980 | Ullman, Jr. | E05D 5/0246 16/235 |
| 4,209,946 | A * | 7/1980 | Akai | E05D 7/0423 16/245 |
| 4,513,474 | A * | 4/1985 | Watabe | E05D 5/046 16/243 |

(Continued)

FOREIGN PATENT DOCUMENTS

| | | |
|---|---|---|
| DE | 2541026 B1 | 1/1977 |
| DE | 8536840 U1 | 2/1990 |
| EP | 0035143 A2 | 9/1981 |

*Primary Examiner* — Chuck Mah

(74) *Attorney, Agent, or Firm* — Cantor Colburn LLP

(57) ABSTRACT

An adjustable corner fitting for a door element is disposed on a center of rotation and/or an axis, including first and second fitting elements, which, at least sectionwise, each include a locating portion for the abutment against the door element and are interconnectable while restraining the door element. A restraining area is formed between the two fitting elements, into which the door element is insertable, and the fitting elements are formed such that a holding element is disposed between the two fitting elements, which is displaceable in relation to the fitting elements. A holding element is non-positively and/or positively connectable to at least one fitting element, wherein the holding element is in operative connection with the connecting element, which serves for supporting the door element on the center of rotation and/or the axis.

15 Claims, 3 Drawing Sheets

(56) References Cited

U.S. PATENT DOCUMENTS 4,689,853 A * 9/1987 Marinoni ..... E05D 5/0246 16/382
4,977,642 A * 12/1990 Marinoni ..... E05D 5/0246 16/257
5,483,770 A * 1/1996 Marinoni ..... E05D 7/0423 16/229
5,613,276 A * 3/1997 Franz ..... A47K 3/36 16/229
6,178,595 B1 * 1/2001 Marinoni ..... E05D 5/0246 16/252
7,493,673 B2 * 2/2009 Garrett ..... E05D 5/0246 16/252
8,528,169 B1 * 9/2013 Yu ..... E05F 3/20 16/238
8,578,556 B1 * 11/2013 Yu ..... E05F 3/104 16/240
2003/0213103 A1 * 11/2003 Cameron ..... A47K 3/36 16/382
2006/0277716 A1 * 12/2006 Sprague ..... A47K 3/36 16/252
2009/0070959 A1 * 3/2009 Balenzano ..... E05D 5/0246 16/277
2013/0185896 A1 * 7/2013 Yu ..... E05F 3/104 16/55

* cited by examiner

ADJUSTABLE CORNER FITTING

TECHNICAL FIELD

The disclosure relates to a corner fitting and a method for disposing a door element on a center of rotation and/or an axis.

BACKGROUND

Conventional door elements, in particular glass doors, such as double-action glass doors or sliding glass doors with fittings, respectively are equipped with fitting devices. The fitting devices mostly comprise two fitting elements, between which the door element, respectively the glass door is clamped. According to specified standards, in addition to clamping, the door elements are optionally retained by attaching means, which pass through the fitting devices and through apertures, for example bores, in the door element. With the intention to clamp the door elements between the fitting elements, a cutout is provided in the corner areas of the door elements along the contour thereof. The fitting elements are placed against the contour of the door element and, in the area of the cutout of the door element, they form a free space, in which the door element, via a connecting element, which is a component of the fitting device and which is preferably disposed between the fitting elements, can be disposed on a center of rotation and/or on an axis.

The corner fittings known on the market are disadvantageous in that they just include a rigid connecting element, i.e. a connecting element for which the position is predetermined. In this case, it is particularly disadvantageous that the known corner fittings can be chosen only for two firm centers of rotation, respectively axes, namely for 55 mm and 65 mm. Therefore, if required, the known corner fittings cannot be adapted to centers of rotation or axes, which differ from the specification of 55 mm and 65 mm. This is in particular disadvantageous in that for example double-action doors can not be adapted to centers of rotation or to axes, which do not correspond to the measure of said centers of rotation or axes. Therefore, with prior art corner fittings, it is not possible to align a double-action door 100% flush on a non-standard center of rotation or an axis.

Therefore, the disclosure overcomes the above-described disadvantages of the state-of-the-art at least partially. Specifically, the disclosure provides a corner fitting for door elements, which allows for a flush alignment of the non-standard door element, in particular to centers of rotation and/or axes other than e.g. 55 mm and e.g. 65 mm.

SUMMARY

Features and details, described in conjunction with the inventive corner fitting are obviously also valid in conjunction with the inventive method, and respectively vice versa, such that mutual reference is made, respectively can be made with respect to the disclosure of individual aspects of the disclosure.

The inventive corner fitting for a door element to be disposed on a center of rotation and/or an axis, including a first fitting element and a second fitting element, wherein each include at least partially a locating portion for the abutment against the door element and are connectable to each other while restraining the door element, includes the technical teaching that a restraining area is formed between the two fitting elements into which the door element can be inserted, and that the fitting elements are configured such that a holding element, which is displaceable in relation to the fitting elements and is non-positively and/or positively connectable to at least one fitting element, is disposed between the two fitting elements, wherein said holding element is in operative connection with a connecting element, which serves for supporting the door element on the center of rotation and/or the axis.

This solution offers the advantage that with the holding element, which is displaceable in relation to the fitting element, the connecting element is displaceable, which is in operative connection with the holding element. Accordingly and via the displacement of the holding element in relation to the fitting element, the connecting element, which serves for supporting the door element on the center of rotation and/or the axis, can be adjusted in a freely selectable manner to the position of the center of rotation and/or the axis, at least within a certain range, which ranges at least between 50 mm and 80 mm. In this case, adjusting the connecting element on the center of rotation and/or the axis is advantageously infinitely variable by displacing the holding element in relation to the fitting element. Therefore, it is possible to align e.g. a door element, which is clamped in the inventive corner fitting, also on a non-standard center of rotation and/or the axis, namely for example other than 55 mm, 65 mm or 70 mm. Insofar the inventive corner fitting is suitable for compensating error tolerances by means of the displaceable, respectively floatingly supported holding element, which is in operative connection with the connecting element. Therefore, the inventive configuration of the inventive corner fitting allows for the overall improved ease of mounting for disposing a door element, in particular a glass door element on a center of rotation and/or an axis.

In an advantageous manner, the at least one fitting element and in a preferred manner both fitting elements include a free space as a guide, in which the holding element is movable. According to the idea of the application, for example a recess, a slot or a groove is understood as a free space, which extends in longitudinal extension of the fitting elements, in at least one of the fitting elements.

According to the idea of the present disclosure, the distance created between the two fitting elements is also understood as free space, which distance allows for moving the holding element, which advantageously includes a head part and a connecting part, with the connecting part in the free space between the fitting elements. In contrast thereto, the free space configured as a recess, slot or groove, which extends in longitudinal extension of the fitting elements, serves for supporting the holding element with its head part to be movable, respectively for attaching the holding element via the head part non-positively and/or positively at least to one fitting element.

With the intention to maintain the adjustment, once the adjustment of the door element on the center of rotation and/or the axis is completed, the displaceability of the holding element is prevented in that the latter is non-positively and/or positively connected via the head part at least to the one fitting element, in particular in the free space, which extends in the at least one fitting element. Thereby, the holding element and therewith also the connecting element operatively connected to the holding element are immobilized in their position in relation the fitting element, whereby the alignment, respectively the adjustment of the door element on the center of rotation and/or the axis is maintained. Obviously, it is also conceivable to prevent the displaceability of the holding element, which is in operative connection with the connecting element, in that the connecting element is non-positively and/or positively connected to at least one of the fitting elements via an attaching element.

In advantageous manner, an attaching mechanism, which is incorporated at the holding element and at the connected and which can be transferred from a released condition into a fixing condition, is suitable as the non-positive and/or positive connection between the holding element and the fitting element. Advantageously in this way, after having completed the alignment, respectively the adjustment of the corner fitting on the center of rotation and/or the axis via the displaceable holding element and the connecting element, which is non-positively and/or positively connected to the holding element, the attaching mechanism can be transferred into the fixing condition, whereby the holding element reaches a non-positive and/or positive abutment at least against one fitting element, and thereby fixes the connecting element in its position on the center of rotation and/or the axis.

Obviously, it is likewise conceivable to delimit the infinitely variable displaceability of the holding element by retaining the latter in predetermined positions, for example via a latching means. In the event the holding element is guided for example in a groove or on a rail at, respectively between the fitting elements, for example latching means or stop points may be configured, which noticeably delimit the free displaceability of the holding element, which means are provided for adjusting the door element on standard centers of rotation and/or axes of 55 mm, 65 mm or 70 mm. If the latching means, respectively the stop points configured in the groove or on the rail, are reached, the holding element can be advantageously moved in the groove respectively on the rail beyond the latching means or the stop point in relation to the fitting element, in case this would be required for the alignment of the door element on the center of rotation and/or the axis, namely in the event the center of rotation and/or the axis non-standard measure, namely other than of 55 mm, 65 mm or 70 mm.

In a particularly advantageous manner, the holding element and the connecting element, which serves for supporting the door element on a center of rotation and/or an axis and is in an operative connection with the holding element, are two structural components of the corner fitting and connected to each other. Said two structural components connected to each other, as already explained, preferably form the attaching mechanism, which is advantageously incorporated at both structural components, namely at the holding element and at the connecting element, and which mechanism can be transferred between the released condition and the fixing condition, wherein the holding element is displaceable in the released condition, and in the fixing condition, it is at least non-positively and/or positively attached at least to one fitting element. Accordingly, on the one hand, the attaching mechanism formed at the holding element and at the connecting element serves for adjusting the corner fitting on a center of rotation and/or an axis, i.e. for displacing the holding element and the connecting element connected to the holding element in particular in relation to the longitudinal extension of the fitting elements. Moreover, the attaching mechanism serves for fixing the corner fitting in the adjusted position, namely for fixing the holding element via the attaching mechanism at least at one of the fitting elements at least non-positively and/or positively.

For establishing an operative connection between the holding element and the connecting element, i.e. for forming the attaching mechanism, the holding element and the connecting element are particularly and advantageously non-positively and/or positively connected to each other via at least one attaching element. The attaching element between the holding element and the connecting element may be for example a screw, such as e.g. a headless screw, which connects the holding element and the connecting element to each other. Particularly advantageously, at least two attaching elements are provided, which connect the holding element to the connecting element. The non-positive and/or positive connection between the holding element and the connecting element, i.e. the transfer of the attaching mechanism from the released condition into the fixing condition, serves in addition in an advantageous manner for immobilizing the holding element at the fitting element. Preferably for this purpose, the fitting element includes a free space as a guide, for example in the shape of a recess, a groove or a rail, at which, respectively in which the holding element is guided, respectively supported to be movable. Advantageously, in this case, the free space in the fitting element is configured such that the holding element is displaceable, respectively guidable in longitudinal extension of the fitting element. As the fitting element, respectively the fitting elements of the corner fitting are aligned parallel to the frontal and/or rear surface of the door element, the displacement of the holding element in longitudinal extension of the fitting element causes a displacement of the door element with the fitting element in the opposite direction to the displacement of the holding element in the longitudinal extension of the fitting element. Thereby, it becomes possible to align the door element, for example within a door casing, to the long sides of the casing and on the center of rotation and/or the axis. If said displaceability of the door element in relation to the center of rotation was not given, for example a double-action door, adjusted on a firm center of rotation and/or a firm axis, would unintentionally contact a wall or another structural glass element with one of its edges, in case of an incorrect position of the center of rotation and/or the axis. In the event an abutment of the double-action door is configured at least partially at another glass door element or at the wall, in case of incorrect adjustment of the corner fitting or in case of incorrect positioning of the center of rotation and/or the axis, the door element could pivot past the abutment.

In advantageous manner, the free space configured as a recess, a groove or a slot, is provided in both fitting elements. The recess, the groove or the slot extend in this case in advantageous manner in longitudinal extension of both fitting elements and extend in the two fitting elements preferably at the same height and parallel to each other. Advantageously, the free space in the fitting elements, referred to as recess, groove or slot, serves for guiding the holding element essentially parallel to the fitting elements and in relation to the longitudinal extension thereof. Advantageously, for this purpose the holding element includes the head part, which serves for supporting the holding element, at least in the released condition of the attaching mechanism, to be movable in the free spaces of both fitting elements. Based on this configuration, in the fixing condition of the attaching mechanism, clamping the holding element via the head part is effective at both fitting elements, namely respectively in the recesses of both fitting elements, whereby the clamping force acting during clamping is advantageously distributed equally on both fitting elements.

In the simplest case, the holding element may be configured as a flat element without the head part, which can be guided between the fitting elements in the longitudinal extension of the fitting elements. In this case, it is conceivable that grooves for example in the shape of oblong holes are formed in the fitting elements, which grooves allow for an infinitely variable non-positive and/or positive attachment of the holding element via attaching elements, which reach through the grooves and the holding element, along the grooves. Obviously, a groove may be provided in just one fitting element, through which the attaching elements reach engagement with the holding element. Thus, for example after the alignment of the door element on the center of rotation and/or the axis is completed, the holding element could be immobilized in its position by means of at least one attaching element reaching through the groove of the fitting element, for example a screw or a pin. As the holding element is in operative connection with the connecting element, as already described, the attaching element reaching through the groove and non-positively and/or positively connecting the fitting element to the holding element, also the connecting element, which serves for supporting the door element on the center of rotation and/or the axis, is immobilized in its position.

Advantageously, the connecting part and the head part of the holding element are configured as a common, monolithic and/or integral structural component. In this case, for example a structural component manufactured in an injection molding process from one or more different components is understood as a monolithic structural component. However, a structural component manufactured from a material, which for example is milled from a metal block by machining a metal block, can be understood as an integral structural component. Preferably, a common structural component is also understood in that the head part and the connecting part are configured as individual parts, which are provided as a common structural component, namely as the holding element in a pre-mounted condition.

In advantageous manner the holding element is configured as an L-profile with a head part and a connecting part, preferably in the shape of two surfaces essentially directed orthogonally to each other, wherein the head part is supported in the free space configured as a groove, as a slot or as a recess in one of the fitting elements to be movable in the released condition of the attaching mechanism, and in the fixing condition of the attaching mechanism, acts in a clamping manner in the recess, and the connecting part is in operative connection with the connecting element. In the event both respective fitting elements have a free space configured as a groove, as a slot or as a recess, the head part of the holding element, respectively the holding element is advantageously configured as a T-profile, for supporting the holding element to be movable in both recesses of the fitting elements, respectively for clamping it. By transferring the attaching mechanism from its released condition into the fixing condition, the holding element configured as a T-profile offers at least sectionwise a resting surface on both sides, i.e. in both free spaces configured as a groove, as a slot or as a recess of the fitting elements, which surface serves for the non-positive and/or positive connection between the holding element and the fitting elements, i.e. in the fixing condition of the attaching mechanism, the head part acts in a clamping manner in both grooves, slots or recesses. In contrast to the holding element configured as an L-profile, the holding element configured as a T-profile clamps equally on both sides of the corner fitting, namely at both fitting elements. Thereby, it is possible to achieve a more stable non-positive and/or positive connection, i.e. an improved clamping action between the holding element and the fitting elements, with the holding element configured as a T-profile compared to the holding element configured as an L-profile. As already described for the holding element configured as an L-profile, in the holding element configured as a T-profile, the connecting element is connected to the holding element via a connecting part.

In addition to the free space configured as a groove, as a slot or as a recess in longitudinal extension of the fitting elements, in at least one of the fitting elements, preferably a free space in the shape of a distance between the fitting elements is formed, which allows for guiding the holding element between the fitting elements at least in relation to the longitudinal extension thereof, wherein the connecting part of the holding element extends through the distance. In this case, in a preferred manner, the free space formed as a distance between the fitting elements is configured to be larger than the material thickness of the connecting part. Preferably, the distance is at least 10% larger with regard to the material thickness of the connecting part, with the intention to always guarantee a sufficient mobility of the holding element via the connecting part thereof in the free space formed as a distance between the fitting elements, independently of the glass thickness of the door element restrained in the corner fitting.

For assisting the compact construction type of the inventive fitting, the head part and the free space formed as a groove, as a slot or as a recess of the fitting elements are configured such that the head part rests with a surface of less than 10 $cm^2$ on a surface of the free space configured as a recess. The head part of the holding element configured in an L-shape rests in particular with a surface of less than 5 $cm^2$ on a surface of the recess. Despite the small resting surface, the inventive corner fitting is able to support a relatively heavy door element, for example a glass door element having a width of 12 mm, on a center of rotation and/or an axis, without loosing the clamping effect between the holding element and the fitting elements in the fixed condition.

With the intention to assist the movement of the holding element in longitudinal extension of the fitting elements, which holding element is connected to the connecting element via the connecting part, a lower recess is embodied at the fitting elements, which is preferably formed parallel to the recess configured as the free space and extends preferably over the same length as the recess configured as the free space. In this case, the lower recess is preferably formed in both fitting elements and extends over the distance of the fitting elements from the one to the other fitting element. Advantageously, the lower recess serves for displacing the connecting element together with the holding element at least sectionwise in longitudinal extension of the fitting elements. For guaranteeing a displacement of the connecting element over the entire length of the lower recess, the contour of the lower recess is adapted to the exterior contour of the connecting element. In case the exterior contour of the connecting element presents for example rounded corners, the contour of the recess has rounded corners as well, which correspond to the shape and the radius of the rounded corners of the exterior contour of the connecting element. In addition and advantageously, the rounded corners of the contour of the recess serve for preventing jamming of the connecting element in the border areas of the lower recess.

Advantageously, the connecting part and the holding element are configured as a common, monolithic and/or integral structural component. In this case, for example a structural component manufactured in an injection molding process from one or more different components is understood as a monolithic structural component. A structural component manufactured from a material, which for example is carved out from the material by machining a material, for example a metal block, can be understood as an integral structural component. Preferably, a common structural component is also understood in that the holding element and the connecting element are configured as individual parts, which are provided as a common structural component in a pre-mounted condition.

The integral construction type of the holding element with the connecting element offers the advantage that attaching elements, which serve for connecting the holding element to the connecting element, can be foregone. In said integral configuration of the holding element with the connecting element, immobilizing the holding element at the fitting elements is advantageously realized with attaching elements, such as for example screw connections, pins or for example latching possibilities.

In the present application, the following terms are understood as follows:

A structural component, which is supported to be displaceable parallel to the fitting elements and serves for displacing the connecting element, which is operatively connected to the holding element, parallel to the fitting elements and to reach non-positive and/or positive abutment at least at one fitting element, is understood as a "holding element". In this case, the holding element may be configured as a single-surface or multi-surface body. Obviously, the holding element may as well be configured of one or more struts connected to each other or otherwise, such as of an angled part. The free space available between the fitting elements and formed by the distance of the fitting elements to each other is the only limiting factor for the type and construction form of the holding element.

A structural component accommodating the center of rotation and/or the axis is understood as the "connecting element". For increasing the variability of the connecting element, said reception may have different sizes, respectively may be adaptable to receptions having different sizes, for example by means of adapter inserts. The connecting element may be a separate structural component, which is in operative connection with the holding element via attaching elements, or it may as well be embodied with the holding element as a common monolithic and/or integral structural component.

The "infinitely variable selection of centers of rotation" is understood to range between approximately 45 mm and 80 mm. Obviously, if required, the inventive corner fitting may be configured to allow for selecting centers of rotation outside the above-described range. However, this would require having to cutout the door element in a larger than usual area and the corner fitting would have to be dimensioned correspondingly to allow for expanding the displaceability of the holding element between the fitting elements.

A free space configured in the shape of grooves, small channels, furrows, shoulders, rails, protrusions, slots and/or for example roller belts, which allows for displaceable, i.e. for a mobile support of the holding element, may be understood as the "free space, which is configured as a recess in at least one fitting element". Obviously, latchings may be provided along the free space, which allow for the holding element to latch in and thus for a pre-adjustment of the door element to given centers of rotation and/or the axes. However, it might be that just latching and/or stop options are configured for standardized centers of rotation and/or the axes.

An inventive method for disposing a door element on a center of rotation and/or an axis via an adjustable corner fitting, in particular via the inventive corner fitting, comprising a first fitting element and a second fitting element, which each include, at least partially, a locating portion for the abutment of the door element and are interconnected while restraining the door element, provides for a connecting element, which is supported in the corner fitting to be displaceable, to be aligned on the center of rotation and/or the axis and, after aligning the connecting element on the center of rotation and/or the axis, the connecting element is non-positively and/or positively connected to at least one fitting element. The inventive method, compared to prior art mounting methods, offers way more ease of mounting, because the adjustment of the corner fitting, with the door element restrained therein, on the center of rotation and/or the axis is realized via the displaceably supported connecting element, and moreover the connecting element serves for fixing the adjustment on the center of rotation and/or the axis by means of a positive connection to at least one fitting element.

With the intention to avoid repeating the advantages of the inventive method, it is referred to the description of the advantageous embodiment of the inventive corner fitting and it is fully and comprehensively referred to the latter.

BRIEF DESCRIPTION OF THE DRAWINGS

Hereinafter, further measures enhancing the disclosure will be illustrated in the following in detail in conjunction with the description of one preferred embodiment of the disclosure based on the Figures. In this context, the features, individually or randomly combined, may be essential to the disclosure.

In the drawings.

Throughout the different Figures, same parts are always identified by the same reference numerals, and therefore they will be normally only described once.

DETAILED DESCRIPTION OF THE DRAWINGS

Figure 1:
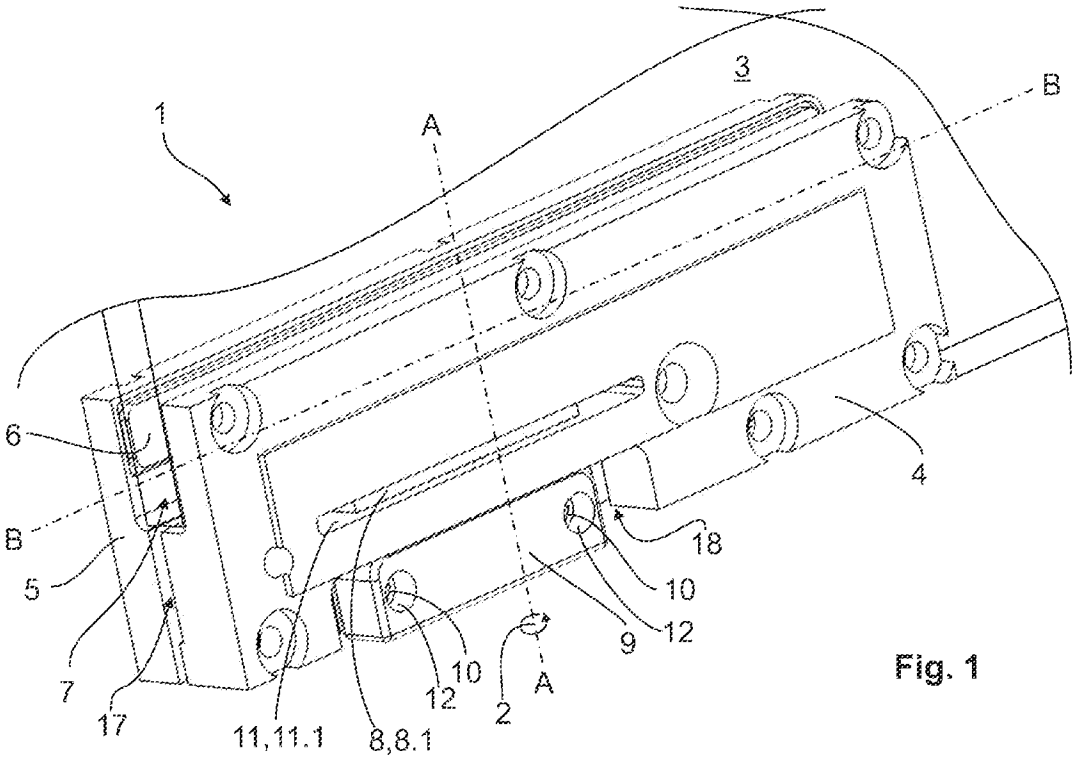
FIG. 1 shows the inventive corner fitting, which is clamped to the left lower corner of a door element, in a perspective side view.

FIG. 1 shows a door element 3, which, via a corner fitting 1, is supported on a center of rotation 2, which may be for example a BTS-axis (floor door closer axis). At the lower left corner of the door element 3, the corner fitting 1 is clamped to the door element 3. The corner fitting 1 illustrated in FIG. 1 is configured such as to be clampable to the top left or the top right or the lower right corner of the door element 3 for supporting the door element 3 on a center of rotation 2 and/or an axis. The corner fitting 1 includes a first fitting element 4 and a second fitting element 5. Both fitting elements 4 and 5 include locating portions 6, which serve at least for indirect abutment via an intermediate layer, not illustrated here, against the door element 3. A restraining area 7, into which the door element 3 is insertable, is formed between the fitting elements 4 and 5. A holding element 8, which is displaceable in relation to the fitting elements 4 and 5 in particular in longitudinal extension of the fitting elements 4 and 5, is disposed between the two fitting elements 4 and 5. A connecting element 9, which is operatively connected to the holding element 8, serves for supporting the door element 3 on the center of rotation 2 and/or the axis. In the present case, the connecting element 9 is non-positively and/or positively operatively connected to the holding element 8 via two attaching elements 10. The holding element 8 in operative connection with the connecting element 9 is guided to be movable in the fitting element 4 and the fitting element 5 in a free space 11 configured as a recess in the shape of a groove. In this case, the free space 11 is configured in the shape of a groove parallel to the longitudinal extension of the fitting elements 4 and 5. The holding element 8 and the connecting element 9, which is in operative connection via the attaching elements 10, are thereby displaceable parallel along the recess 11.1, i.e. with regard to, respectively in the longitudinal extension of the fitting elements 4 and 5. As the connecting element 9 with the holding element 8 is displaceable in relation to the door element 3 in the opposite direction, the door element 3 can be infinitely variably aligned on the center of rotation 2 along the axis BB, for example in its position in a door frame or a glass door installation. In the event e.g. the center of rotation 2, respectively the axis of rotation of the door element 3, represented by the axis AA, is located outside the ranges determined for the usual centers of rotation 2, namely outside of 55 mm, 65 mm or 70 mm, the door element 3 may be adjusted on the center of rotation and/or the axis by displacing the holding element 8 and thereby by the connecting element 9, which is operatively connected to the holding element 8. In the present case, the holding element 8 and the connecting element 9 are configured as two interconnected structural components comprising the attaching mechanism, which in the present case is incorporated into both structural components, namely the holding element 8 and the connecting element 9. For transferring the attaching mechanism from a released condition, in which the holding element 8 is supported to be movable in the longitudinal extension of the fitting elements 4 and 5, into the fixing condition, the attaching elements 10, which connect the holding element 8 via the connecting part to the connecting element 9, are screwed into the through-holes 12. When screwing the attaching elements 10 into the connecting part of the holding element 8, the head part 8.1 of the holding element 8 gets clamped at least sectionwise at least non-positively in the free space 11, configured as a recess 11.1 in the form of a groove, at the fitting elements. Thus, in the fixing condition of the attaching mechanism, the displaceability of the holding element 8 and of the connecting element 9 operatively connected to the holding element 8 is disabled, respectively the holding element 8 is immobilized in its position at the fitting elements 4 and 5.

With the intention to assist the movement of the holding element 8 in longitudinal extension of the fitting elements 4 and 5, which holding element is connected to the connecting element 9 via the connecting part 8.2, a lower recess 18 is configured at the fitting elements 4 and 5, which is preferably formed parallel to the recess 11.1 configured as a free space 11 and preferably extends over the same length as a recess 11.1 configured as the free space 11. In this case, the lower recess 18 is preferably formed in both fitting elements 4 and 5 and extends over the distance 17 of the fitting elements from the one to the other fitting element 4 and 5.

Figure 2:
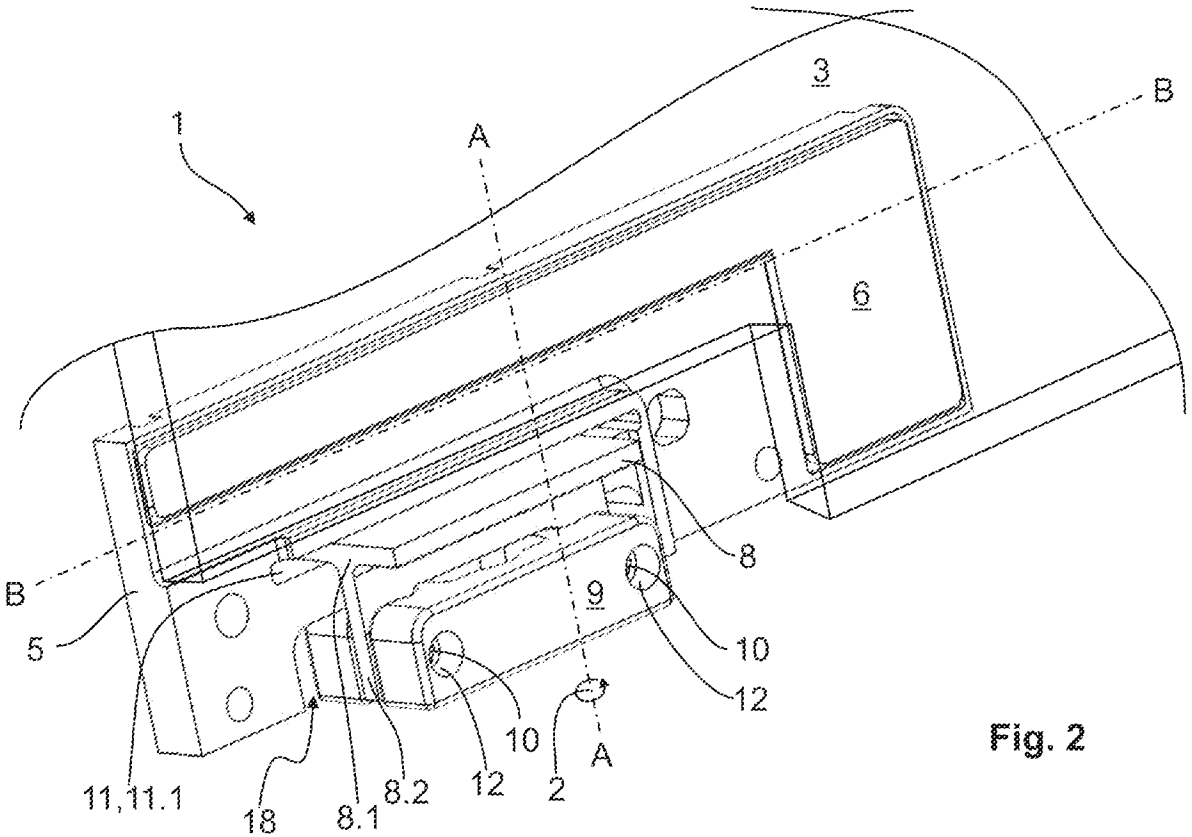
FIG. 2 shows the corner fitting of FIG. 1, wherein, for illustrating the support of the holding element, the front fitting element is not illustrated.

FIG. 2 shows the corner fitting 1 without the front fitting element 4 for a better illustration of the support of the holding element 8 in the corner fitting 1. As can be seen, outside the locating portion 6, the door element 3 includes a cutout according to the known glass cutout standards and, outside the cutout, bears against the locating portions 6 of the fitting elements 4 and 5. A free space, which serves for disposing the holding element 8 and the connecting element 9, is created in the corner fitting 1 in the area of the cutout of the door element 3. As can be additionally seen in FIG. 2, the attaching mechanism just comprises the holding element 8 and the connecting element 9, which are interconnected via two attaching elements 10, which can be manipulated via the through-holes 12 configured at the connecting element 9. Tightening the attaching elements 10 causes in this case that the holding element 8, at least non-positively engages in the free space 11 configured as a recess 11.1 in the shape of a groove of the fitting element 5. In the fixing condition of the attaching mechanism, in this case just a small part of the surface of the head part 8.1 of the holding element 8 rests on a surface of the free space 11 configured as a recess 11.1.

Figure 3:
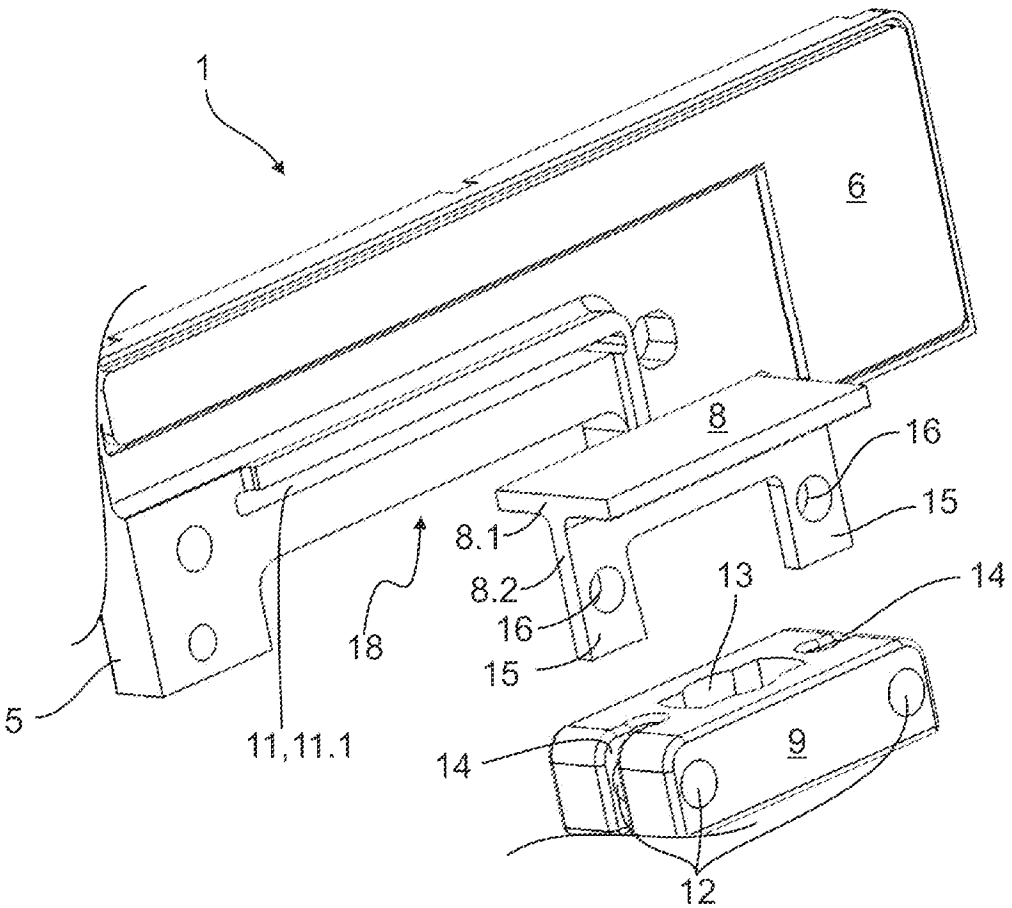
FIG. 3 shows the rear fitting element, the holding element and the connecting element in the non-mounted condition in an exploded view.

FIG. 3 shows the rear fitting element 5, the holding element 8 and the connecting element 9 in the non-mounted condition. As can be seen, the locating portion 6 is just configured in sections. The locating portion 6 follows in particular the contour of the cutout corner area of the door element 3. Attaching elements 10, not illustrated in the present case, serve for the non-positive and/or positive connection between the connecting element 9 and the holding element 8. The attaching elements 10 pass through or are screwed into through-holes 12 in the shape of bores configured in the connecting element 9, which are advantageously embodied as internal thread bores and into which an attaching element 10 configured as a screw engages non-positively and/or positively. Together with the attaching elements 10, the connecting element 9 and the holding element 8 form the attaching mechanism, which is transferable from a displaceable support of the holding element 8 in a released condition into a fixing condition, in which the holding element 8 is at least non-positively coupled to the fitting element. In the condition of the non-positive coupling of the holding element 8 to the fitting element 4 and/or 5, a previously performed alignment, respectively adjustment of the corner fitting on the axis or the center of rotation can be immobilized.

The connecting element 9, which is operatively connected to the holding element 8, has a reception 13 almost in the center, which serves for disposing the door element 3 on the center of rotation 2 and/or the axis. Advantageously in this case, the reception 13 is adaptable to the center of rotation 2 and/or the axis, for example by means of different adapters. As, in the present exemplary embodiment, the connecting element 9 is a single component of the corner fitting, with differently dimensioned receptions 13, it may obviously be variably connected to the holding element 8 and thus form the attaching mechanism. For connecting the holding element 8 to the connecting element 9, the connecting element 9 has apertures 14 configured in the area of the through-holes 12, which serve for the accommodation of tappets 15, which are configured at the holding element 8 and are formed at the connecting part of the holding element 8. The tappets 15 have respectively one bore 16, through which the attaching elements 10 engage, which are guided in the through-holes 12. Preferably, the attaching elements 10 serve in this case for transferring the attaching mechanism, which is formed among others from the connecting element 9 and the holding element 8, into different functional conditions. On the other hand, the connecting element 9 and the holding element 8 are non-positively and/or positively connected via the attaching elements 10 and thereby form a pre-mounted integral structural component. The surface configured at the head part of the holding element 8 is guided in the fitting element 5 in the free space 11 configured as a recess in the shape of a groove.

The invention claimed is:

1. A corner fitting for a door element to be disposed on a center of rotation and/or an axis, including a first fitting element and a second fitting element, which, at least sectionwise, each include a locating portion for the abutment against the door element and are interconnectable while restraining the door element, wherein a restraining area is formed between the fitting elements, into which the door element is insertable, and the fitting elements are formed such that a holding element is disposed between the fitting elements, which is displaceable in relation to the fitting elements and is non-positively or positively connectable to at least one fitting element, wherein the holding element is in connection with a connecting element, configured for supporting the door element on the center of rotation and/or the axis.

2. The corner fitting according to claim 1, wherein the fitting elements each include a free space as a guide, in which the holding element is movable.

3. The corner fitting according claim 1, wherein an attaching element is incorporated at the holding element and at the connecting element, which mechanism is transferable between a released condition wherein the holding element is displaceable at the fitting elements, and a fixing condition wherein the holding element non-positively or positively connected to at least one fitting element.

4. The corner fitting according to claim 1, wherein the holding element is non-positively or positively connected to the fitting element via at least one attaching element.

5. The corner fitting according to claim 4, wherein an alignment of the connecting element on the center of rotation and/or the axis is realized by releasing the non-positive or positive connection between the holding element and the fitting element.

6. The corner fitting according to claim 1, wherein a free space includes a recess in at least one fitting element, wherein the recess extends along the longitudinal extension of the fitting element and the holding element with a head part is supported to be movable in the recess.

7. The corner fitting according to claim 6, wherein in a fixing condition the head part acts in a clamping manner in the recess.

8. The corner fitting according to claim 6, wherein the holding element includes a connecting part, to which the connecting element is attached, wherein the head part and the connecting part form a monolithic or an integral structural component.

9. The corner fitting according to claim 1, wherein the holding element is configured as a T-profile or an L-profile.

10. The corner fitting according to claim 1, wherein there is a distance between the fitting elements, through which a connecting part extends, wherein the distance is larger than the material thickness of the connecting part.

11. The corner fitting according to claim 6, wherein the head part with a surface of less than 10 $cm^2$ rests on a surface of the recess.

12. The corner fitting according to claim 1, wherein the fitting elements are embodied with a lower recess, in which the connecting element is displaceable.

13. The corner fitting according to claim 1, wherein the connecting element and the holding element are configured as a common, monolithic, or integral structural component.

14. A method for disposing a door element on a center of rotation and/or an axis via a corner fitting according to claim 1, including a first fitting element and a second fitting element, which, at least sectionwise, each include a locating portion for the abutment against the door element and are interconnected while restraining the door element, wherein a connecting element, which is supported in the corner fitting to be displaceable and is in operative connection with a holding element, is aligned on the center of rotation and/or the axis, and, after aligning the connecting element on the center of rotation and/or the axis, the connecting element is non-positively or positively attached at least to one fitting element.

15. The method according to claim 14, wherein the connecting element is non-positively and/or positively connected to the fitting element via the holding element.

* * * * *